US008616543B2

(12) United States Patent
Ikeura et al.

(10) Patent No.: US 8,616,543 B2
(45) Date of Patent: Dec. 31, 2013

(54) GUIDE DEVICE AND IMAGE FORMING APPARATUS

(75) Inventors: Shun Ikeura, Yokohama (JP); Kenichi Ishikura, Yokohama (JP); Takayuki Yazawa, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/564,480

(22) Filed: Aug. 1, 2012

(65) Prior Publication Data

US 2013/0249162 A1 Sep. 26, 2013

(30) Foreign Application Priority Data

Mar. 21, 2012 (JP) ..... 2012-063315

(51) Int. Cl.
*B65H 3/44* (2006.01)

(52) U.S. Cl.
USPC ..... 271/9.07; 271/9.09; 271/9.11; 271/164

(58) Field of Classification Search
USPC ..... 271/9.07, 9.09, 9.11, 145, 164
See application file for complete search history.

(56) References Cited

U.S. PATENT DOCUMENTS 7,448,609 B2 * 11/2008 Terashima et al. ..... 271/9.08
7,748,692 B2 * 7/2010 Shiohara ..... 271/9.11
7,883,082 B2 * 2/2011 Asada ..... 271/9.11
8,333,523 B2 * 12/2012 Asada ..... 400/188
8,474,809 B2 * 7/2013 Izuchi et al. ..... 271/9.11
8,508,819 B2 * 8/2013 Asada et al. ..... 358/498
2002/0117797 A1 * 8/2002 Kawarama ..... 271/9.09
2006/0180976 A1 * 8/2006 Shin ..... 271/9.07
2008/0197561 A1 8/2008 Asakawa et al.
2011/0285074 A1 * 11/2011 Shiohara et al. ..... 271/4.01

FOREIGN PATENT DOCUMENTS

JP 2007-062887 A 3/2007
JP 2008-195522 A 8/2008

* cited by examiner

*Primary Examiner* — Jeremy R Severson
(74) *Attorney, Agent, or Firm* — Sughrue Mion, PLLC

(57) ABSTRACT

A guide device includes a plate on which a first medium is to be placed, and provided above a space in which a container is to be inserted, a moving member that moves along a surface of the plate in a supply direction of the first medium or in an opposite direction, a substantially sheetlike guide member that guides the first medium in the supply direction, and a drawing member that draws the moving member toward the plate. When the container is taken out of the space, the moving member is drawn toward the plate in the opposite direction by the drawing member, and the guide member withdraws to a position superposed on the plate. When the container is inserted in the space, the moving member is pushed in the supply direction by the container, and the guide member protrudes from the position in the supply direction.

11 Claims, 14 Drawing Sheets

GUIDE DEVICE AND IMAGE FORMING APPARATUS

CROSS-REFERENCE TO RELATED APPLICATIONS

This application is based on and claims priority under 35 USC 119 from Japanese Patent Application No. 2012-063315 filed Mar. 21, 2012.

BACKGROUND

Technical Field

The present invention relates to a guide device and an image forming apparatus.

SUMMARY

According to an aspect of the invention, there is provided a guide device including: a plate having an upper surface on which a first medium is to be placed, and provided above a space in which a container containing a second medium different from the first medium is to be inserted; a moving member that moves along a surface of the plate in a supply direction of the first medium or in a direction opposite to the supply direction; a substantially sheetlike guide member provided on the moving member to extend from the moving member in the supply direction, the guide member guiding the first medium in the supply direction; and a drawing member that draws the moving member toward the plate. When the container is taken out of the space, the moving member is drawn toward the plate by the drawing member and is moved in the direction opposite to the supply direction, and the guide member withdraws to a position superposed on the plate. When the container is inserted in the space, the moving member is pushed in the supply direction by the container, and the guide member protrudes from the position in the supply direction.

BRIEF DESCRIPTION OF THE DRAWINGS

An exemplary embodiment of the present invention will be described in detail based on the following figures, wherein.

DETAILED DESCRIPTION

1. Exemplary Embodiment

1-1. Overall Configuration

Figure 1:
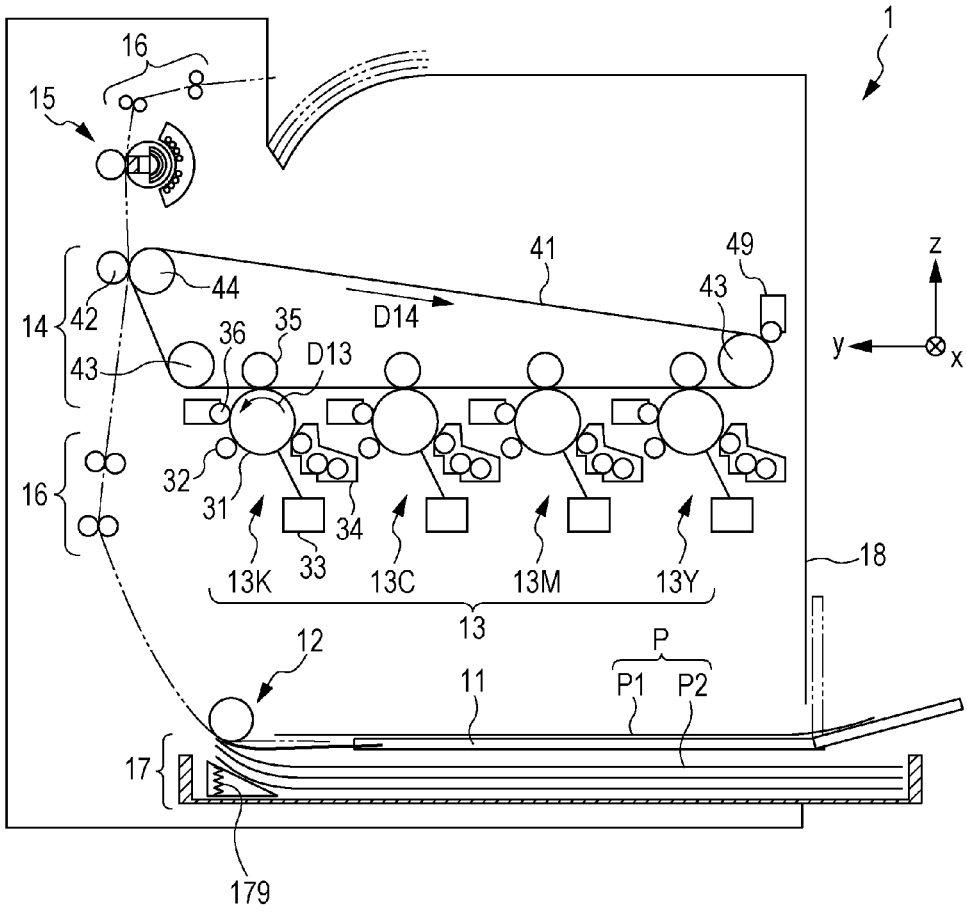
FIG. 1 illustrates an overall configuration of an image forming apparatus according to an exemplary embodiment.

FIG. 1 illustrates an overall configuration of an image forming apparatus 1 according to an exemplary embodiment. As illustrated in FIG. 1, the image forming apparatus 1 includes a guide device 11, a supply unit 12, developing units 13Y, 13M, 13C, and 13K, a transfer unit 14, a heating unit 15, a transport unit 16, a container 17, and a housing 18. Letters Y, M, C, and K appended to the image forming units 13Y, 13M, 13C, and 13K represent yellow, magenta, cyan, and black colors of toner, respectively. The developing units 13Y, 13M, 13C, and 13K are not greatly different in structure except in toner to be used. Accordingly, in the following description, the appended letters are omitted, except where it is otherwise necessary to distinguish among the developing units 13Y, 13M, 13C, and 13K, and the developing units 13Y, 13M, 13C, and 13K are collectively referred to as "developing units 13."

The container 17 contains a sheet P serving as a medium cut to a predetermined size. The guide device 11 allows a medium, on which an image is to be formed, to be manually fed. A sheet P placed on an upper surface of the guide device 11 is supplied to the supply unit 12. The guide device 11 is provided above a space in which the container 17 is to be inserted. Hereinafter, to distinguish between these sheets P, a sheet P placed on the upper surface of the guide device 11 is referred to as a first sheet P1 (first medium) and a sheet P contained in the container 17 is referred to as a second sheet P2 (second medium).

The supply unit 12 includes a supply roller that supplies a sheet P to the transport unit 16 while being in contact with the sheet P. Sheets P placed in the guide device 11 are fed out one by one by the supply roller according to instructions from an unillustrated controller, and are supplied to the transport unit 16. A medium is not limited to a sheet of paper, and may be a resin sheet as an example. In short, any medium may be used as long as an image can be recorded on a surface thereof.

The transport unit 16 includes transport rollers. The transport unit 16 transports a sheet P supplied from the supply unit 12 to the transfer unit 14. The transport unit 16 also transports, to the outside of the housing 18 of the image forming apparatus 1, a sheet P that has passed through the transfer unit 14 and the heating unit 15.

Each developing unit 13 includes a photoconductor drum 31, a charger 32, an exposure device 33, a developing device 34, a first transfer roller 35, and a drum cleaner 36. The photoconductor drum 31 is an image carrier including a charge generating layer and a charge transport layer, and is rotated in a direction of arrow D13 by an unillustrated driving unit. The charger 32 charges a surface of the photoconductor drum 31. The exposure device 33 includes a laser-light emitting source, a polygonal mirror, etc. (not illustrated), and applies laser light based on image data onto the photoconductor drum 31 charged by the charger 32 under the control of the controller, so that a latent image is carried on the photoconductor drum 31. The image data may be acquired by the controller from an external apparatus via an unillustrated communication unit. For example, the external apparatus is a reading apparatus that reads an original image or a storage apparatus that stores data on an image.

The developing device 34 contains a two-component developer including toner of any of the colors Y, M, C, and K, and magnetic carriers such as ferrite powder. When tips of naps of magnetic blushes formed in the developing device 34 contact with the surface of the photoconductor drum 31, the toner is attached to a portion of the surface of the photoconductor drum 31 exposed by the exposure device 33, that is, an image area of an electrostatic latent image, thereby forming (developing) an image on the photoconductor drum 31.

The first transfer roller 35 generates a predetermined potential difference at a position where an intermediate transfer belt 41 in the transfer unit 14 opposes the photoconductor drum 31, and transfers the image onto the intermediate transfer belt 41 by the potential difference. The drum cleaner 36 removes untransferred toner remaining on the surface of the photoconductor drum 31 after transfer of the image, and eliminates charge from the surface of the photoconductor drum 31. That is, the drum cleaner 36 removes unnecessary toner and charge from the photoconductor drum 31 in preparation for the next image forming operation.

The transfer unit 14 includes the intermediate transfer belt 41, a second transfer roller 42, belt transport rollers 43, and a backup roller 44, and transfers images formed by the developing units 13 onto a sheet P of a type determined by user operation. The intermediate transfer belt 41 is an endless belt member, and is stretched by the belt transport rollers 43 and the backup roller 44. At least one of the belt transport rollers 43 and backup roller 44 is provided with a driving unit (not illustrated), and moves the intermediate transfer belt 41 in a direction of arrow D14 in FIG. 1. The other rollers that do not have the driving unit rotate along with movement of the intermediate transfer belt 41. When the intermediate transfer belt 41 circulates in the direction of arrow D14, an image on the intermediate transfer belt 41 is moved to an area nipped between the second transfer roller 42 and the backup roller 44.

The second transfer roller 42 transfers an image on the intermediate transfer belt 41 onto a sheet P transported from the transport unit 16 by a potential difference from the intermediate transfer belt 41. A belt cleaner 49 removes untransferred toner remaining on the surface of the intermediate transfer belt 41. The transfer unit 14 or the transport unit 16 transports the sheet P to the heating unit 15 after the image is transferred on the sheet P. The developing unit 13 and the transfer unit 14 serve as an example of an image forming unit of the exemplary embodiment that forms an image on a medium.

For example, the heating unit 15 includes a magnetic-field generating circuit that generates a magnetic field, a heating belt that generates heat by electromagnetic guide caused by the action of the generated magnetic field, and a pressurizing roller that transports the sheet P while nipping the sheet P between the pressurizing roller and the heating belt. The heating unit 15 fixes the image transferred on the sheet P by heating the sheet P.

1-2. Configuration of Guide Device

Figure 2:
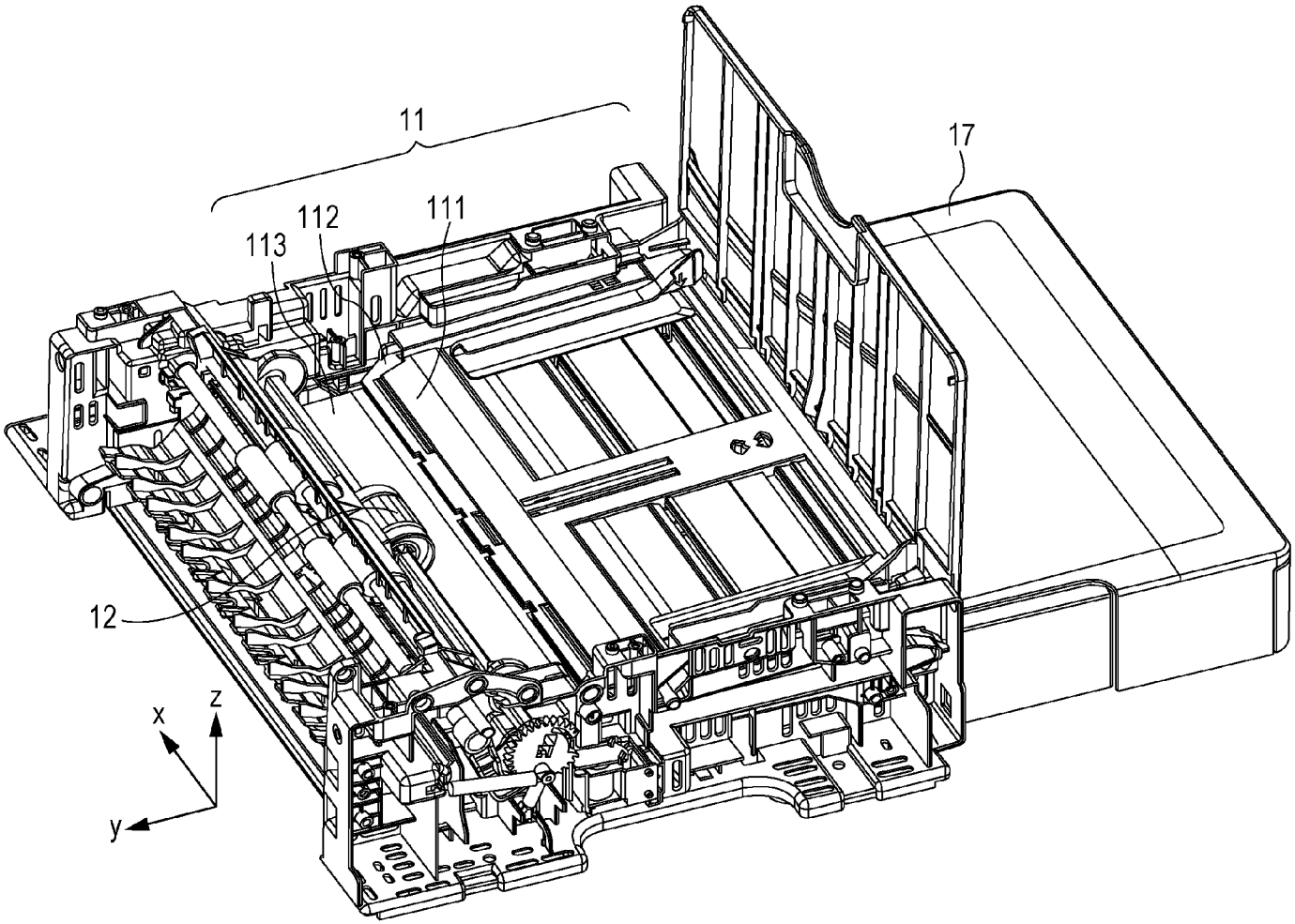
FIG. 2 schematically illustrates a guide device.

FIG. 2 schematically illustrates the guide device 11. To describe the layout of the structures in the guide device 11, a space where the structures are provided will be hereinafter illustrated as a right-handed coordinate space of an x-axis, a y-axis, and a z-axis. In the drawings, a coordinate symbol in which two lines intersect in a white circle indicates an arrow extending from a front side toward a depth side of paper. In the space, a direction along the x-axis is referred to as an x-axis direction. In the x-axis direction, a direction in which an x-component increases is referred to as a +x-direction, and a direction in which the x-component decreases is referred to as a −x-direction. For y- and z-components, a y-axis direction, a +y-direction, a −y-direction, a z-axis direction, a +z-direction, and a −z-direction are also defined. A direction in which the supply unit 12 feeds out and supplies sheets P from the guide device 11 to the transport unit 16 corresponds to the +y-direction, a direction in which the sheets P are stacked in the guide device 11 and the container 17 corresponds to the +z-direction, and a width direction of the sheets P corresponds to the x-axis direction. A downward direction in the image forming apparatus 1, that is, a direction in which gravity acts corresponds to the −z-direction.

A plate 111 is provided above the space in which the container 17 is to be inserted, and a first sheet P1 is to be placed on an upper surface of the plate 111. A moving member 112 moves along a surface of the plate 111 (a lower surface in the exemplary embodiment) in a direction in which the sheet P1 is supplied (hereinafter referred to as a supply direction) or in an opposite direction. The moving member 112 is provided with a guide member 113 that extends in the supply direction. The guide member 113 is a sheetlike or substantially sheetlike flexible member, and is formed of resin for example. FIG. 2 illustrates a state in which the moving member 112 is moved along the surface of the plate 111 in the supply direction so that the guide member 113 protrudes in the supply direction from a position superposed on the plate 111. Since the moving member 112 protrudes the guide member 113 in the supply direction, an end of the guide member 113 in the supply direction, that is, in the +y-direction is located closer to the supply roller of the supply unit 12 than before the guide member 113 is protruded. A first sheet P1 placed on an upper surface of the guide member 113 is guided in the supply direction, and is supplied to the transport unit 16 by the supply roller from the end close to the supply roller.

Figure 3:
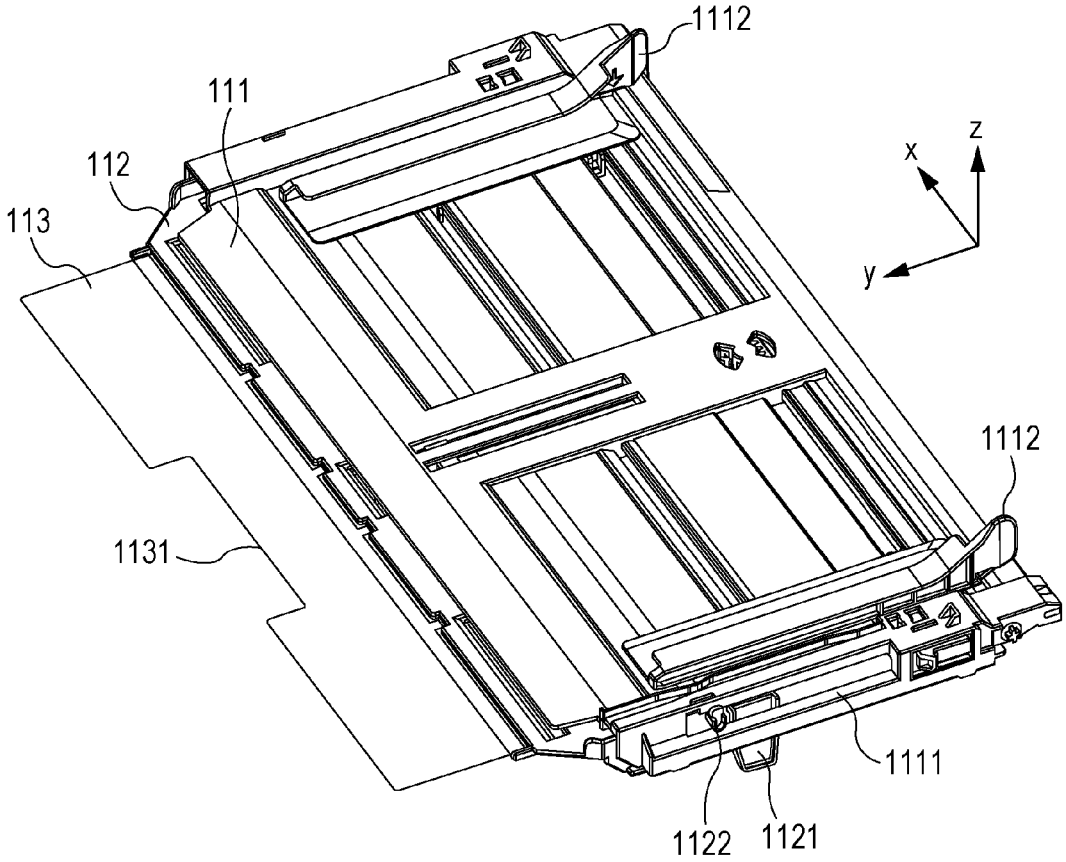
FIG. 3 illustrates details of the guide device illustrated in FIG. 2.

FIG. 3 illustrates details of the guide device 11 of FIG. 2. The moving member 112 has one pressed portion 1121 and one projecting portion 1122 at each of a +x-direction end and a −x-direction end thereof. The plate 111 has, at each of a +x-direction side and a −x-direction side, one slot 1111 extending in the y-axis direction and one side guide 1112 for determining the position in the width direction of a first sheet P1 placed on the upper surface of the guide member 113.

Each pressed portion 1121 extends in the −z-direction from the corresponding end of the moving member 112, and has a surface that receives a force of pressing from the −y-direction side toward the +y-direction side. Each projecting portion 1122 is located in the slot 1111 provided on the same side, and moves in the longitudinal direction of the slot 1111, that is, in the y-axis direction. Thus, the moving member 112 moves along the lower surface of the plate 111 in the y-axis direction. When the moving member 112 moves in the y-axis direction, the guide member 113 provided on the moving member 112 also moves in the y-axis direction.

Figure 4:
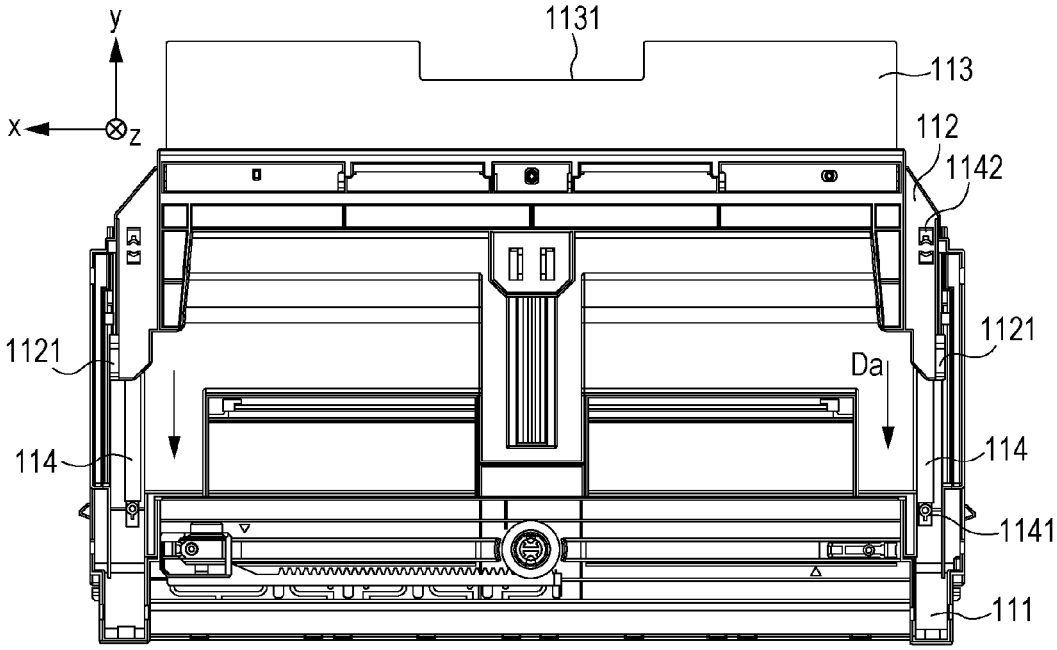
FIG. 4 is a bottom view of the guide device.

FIG. 4 illustrates the guide device 11, as viewed from below to above, that is, in the z-axis direction from the −z-direction side to the +z-direction side. The guide device 11 has, at each of a +x-direction end and a −x-direction end, one spring 114 serving as a drawing member that draws the moving member 112 toward the plate 111. Both springs 114 are laid between the moving member 112 and the plate 111 in the supply direction. The springs 114 are fixed at rear ends 1141 in the supply direction to the plate 111, and are fixed at front ends 1142 in the supply direction to the moving member 112. Thus, the springs 114 draw the moving member 112 in a direction of arrow Da in FIG. 4, that is, in the −y-direction.

The −y-direction is opposite to the +y-direction serving as the supply direction. When both pressed portions 1121 are pressed against the direction of arrow Da, that is, pressed in the +y-direction, the moving member 112 moves in the +y-direction and protrudes the guide member 113 forward in the supply direction from the position superposed on the plate 111, as illustrated in FIG. 4.

Figure 5:
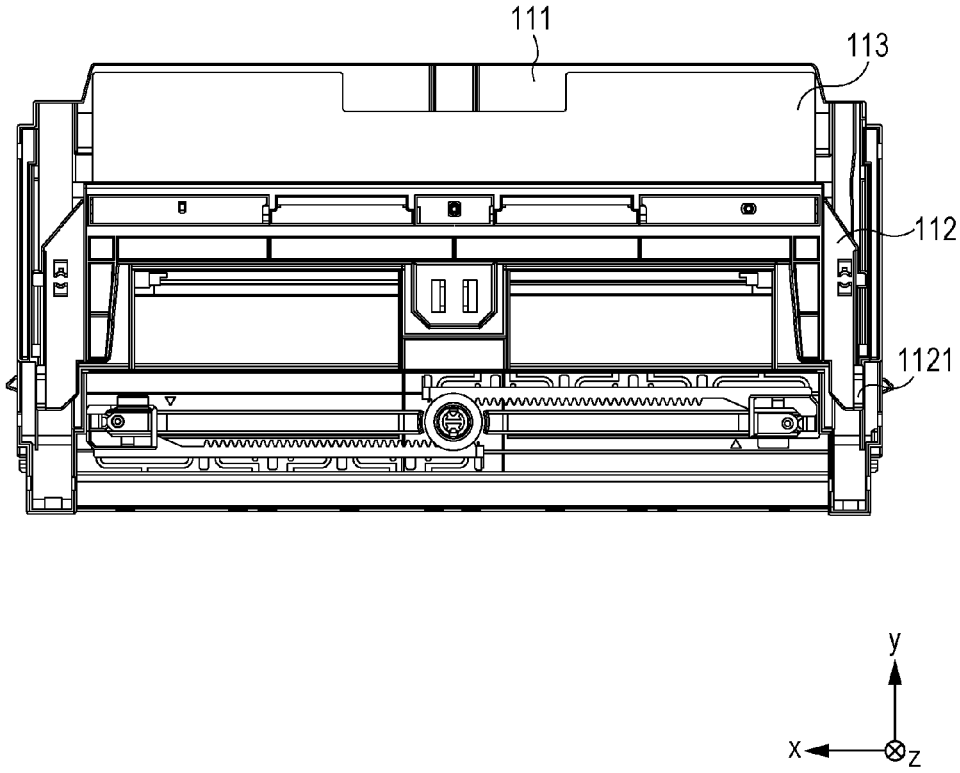
FIG. 5 is a bottom view of the guide device in which pressed portions are not pressed.

In contrast, when the pressed portions 1121 are not pressed in the +y-direction, the springs 114 draw the moving member 112 toward the plate 111. FIG. 5 is a bottom view of the guide device 11 in a state in which the pressed portions 1121 are not pressed. In this case, since the springs 114 draw the moving member 112 toward the plate 111, the guide member 113 is located at the position superposed on the plate 111. At this time, the guide member 113 does not need to be entirely superposed on the plate 111, and it is satisfactory as long as at least a part of the guide member 113 is superposed on the plate 111. From a viewpoint of protection, the guide member 113 can be located at the position entirely superposed on the plate 111, as illustrated in FIG. 5.

Figure 6:
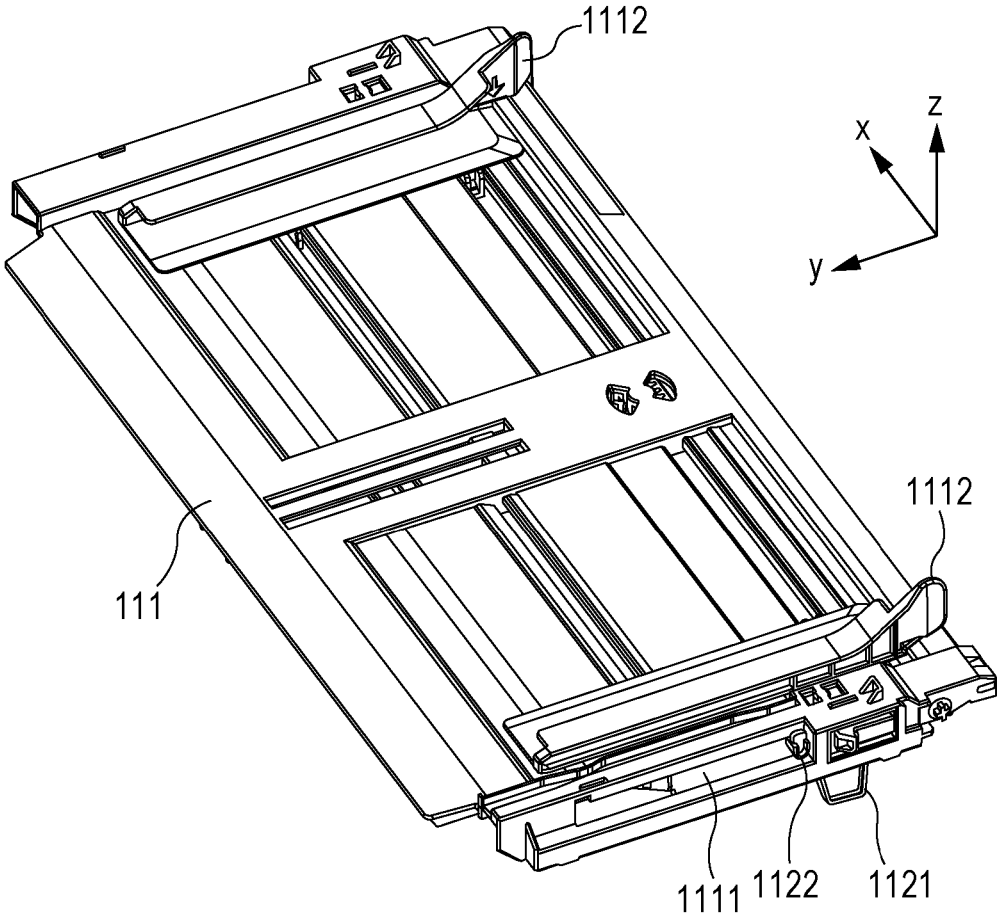
FIG. 6 illustrates a state in which a guide member is located at a position superposed on a plate.

FIG. 6 illustrates a state in which the guide member 113 is placed at the position superposed on the plate 111. While the guide member 113 is a sheetlike or substantially sheetlike flexible member, as described above, the plate 111 has rigidity higher than that of the guide member 113. For this reason, even if some force is applied to the guide member 113 placed at the position of FIG. 6 from the upper side, that is, from the plate 111 side, the guide member 113 is protected by the plate 111. Therefore, the guide member 113 is unlikely to be damaged.

1-3. Operation of Guide Device

Figure 7:
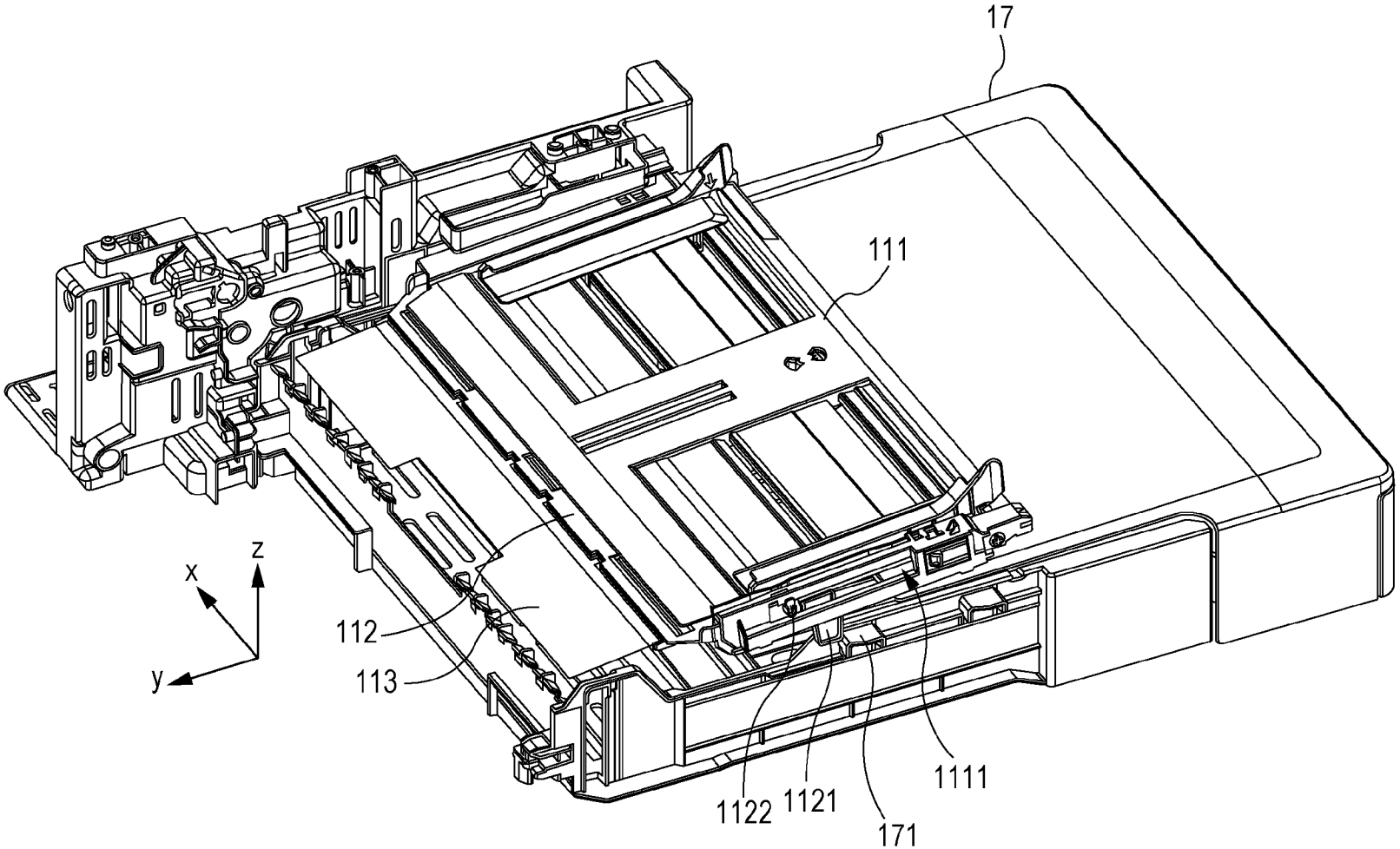
FIG. 7 illustrates how the guide device operates when a container is inserted.

FIG. 7 illustrates how the guide device 11 operates when the container 17 is inserted. The container 17 has pressing members 171 projecting to both sides in the width direction of a sheet P (in the +x-direction and −x-direction). When the container 17 is inserted in the +y-direction into the space below the guide device 11, the pressing members 171 come into contact with the pressed portions 1121 provided on the same sides, and push the pressed portions 1121 in the +y-direction.

Figure 8:
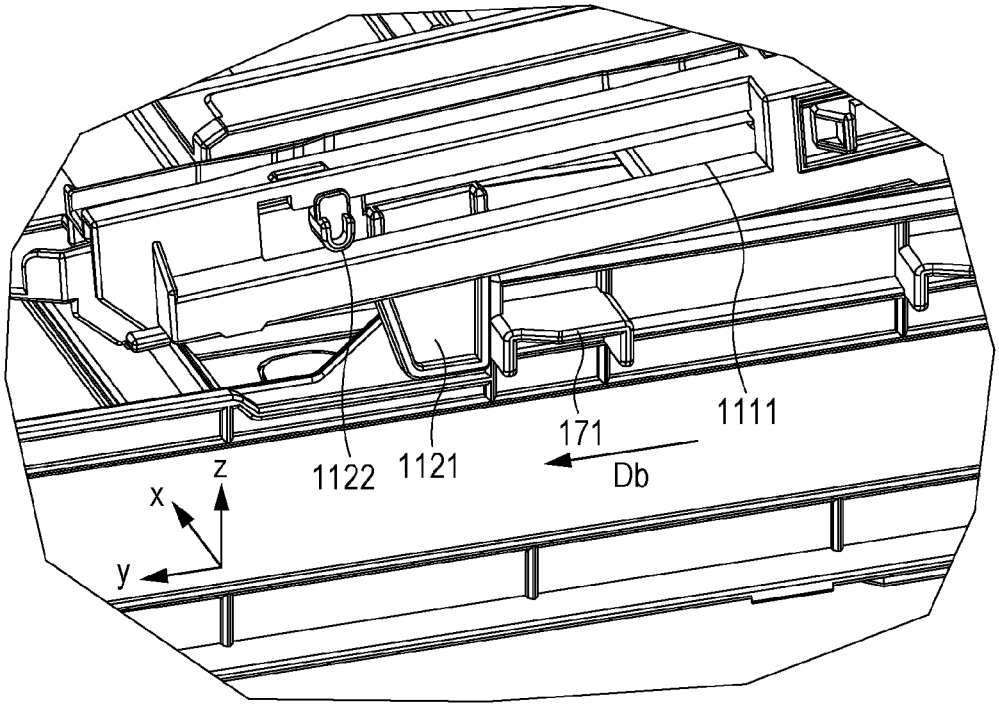
FIG. 8 illustrates a state in which a pressing member is in contact with a pressed member.

FIG. 8 illustrates a state in which the pressing members 171 are in contact with the pressed member 1121. As the container 17 is inserted, the pressing members 171 move in a direction of arrow Db and come into contact with the pressed portions 1121, as illustrated in FIG. 8. When the pressed members 1121 receive pressing force from the pressing members 171, they move in the direction of arrow Db against the elastic force of the springs 114. At this time, since the projecting portions 1121 move along the slots 1111, the moving member 112 moves in the +y-direction. As a result, the guide member 113 protrudes in the +y-direction from the position superposed on the plate 111.

The container 17 has a lift 179 on its front side in the inserting direction. The lift 179 is schematically illustrated in FIG. 1. The lift 179 pushes up a front end of a second sheet P2 in the inserting direction by means of a raising member such as a spring. While the container 17 is not in contact with the innermost part of the housing 18 of the image forming apparatus 1, a member is placed at an upper position to limit the elastic force of the raising member. When the container 17 is inserted into contact with the innermost part of the housing 18 of the image forming apparatus 1, the above-described member is removed from above the lift 179, and therefore, the elastic force of the raising member is released. Then, the lift 179 pushes up the front end of the second sheet P2 in the inserting direction.

When the container 17 is in contact with the innermost part of the housing 18 of the image forming apparatus 1, the guide member 113 is located above the lift 179 while being protruded forward in the supply direction from the position superposed on the plate 111 by the moving member 112. Since the guide member 113 is a sheetlike or substantially sheetlike flexible member, it is pushed up from below and is bent upward by the second sheet P2 that is pushed up by the lift 179. Since the supply roller of the supply unit 12 is located above the lift 179 and the guide member 113, the guide member 113 bent upward presses the first sheet P1 placed on the upper surface against the supply roller of the supply unit 12. That is, when the container 17 is loaded, the guide member 113 is pushed up by the second sheet P2 (medium) contained in the container 17, and is bent in a direction to press the first sheet P1 on the upper surface against the supply roller.

The guide member 113 has a cutout portion 1131 illustrated in FIGS. 3 and 4. The cutout portion 1131 is provided at the front end of the guide member 113 in the supply direction and at the center in the width direction, and recedes rearward from both ends in the width direction. Since the supply roller of the supply unit 12 is provided above the cutout portion 1131, when all first sheets P1 placed on the upper surface of the guide member 113 run out, the supply roller is placed below the guide member 113 and comes into contact with the second sheet P2 that is contained in the container 17 and pushes up the guide member 113. Therefore, when all first sheets P1 on the upper surface of the guide member 113 run out, the supply roller of the supply unit 12 takes the second sheet P2 out from the container 17 and supplies the second sheet P2 to the transport unit 16.

As described above, when the container 17 is inserted in the space below the guide device 11, the moving member 112 of the guide device 11 is pushed in the supply direction by the container 17, and protrudes the guide member 113 in the supply direction from the position superposed on the plate 111. Hence, the first sheet P1 placed on the upper surface of the guide member 113 is supplied by the supply unit 12. When the container 17 is taken out from the space below the guide device 11, the moving member 112 is drawn toward the plate 111 by the springs 114, and the guide member 113 withdraws to the position superposed on the plate 111. Hence, the flexible guide member 113 is protected by the plate 111. Further, even if the guide member 113 is located in a path along which the container 17 is taken out, it withdraws while the container 17 is being taken out. Therefore, the guide member 113 is unlikely to be damaged.

2. Modifications

While the exemplary embodiment has been described above, it can be modified as follows. The following modifications may be combined.

2-1. First Modification

The guide device 11 may be removably mounted in the housing 18 of the image forming apparatus 1. For example, when the container 17 is not inserted in the inner space of the housing 18, the plate 111 may be inserted in the inserting direction of the container 17 to be located above the space where the container 17 is to be inserted. In this case, the guide device 11 is moved along grooves provided in portions of an inner wall of the housing 18 opposing both ends of the plate 111 in the width direction, that is, a +x-direction end and a −x-direction end. Further, since the pressed members 1121 of the guide device 11 are pressed in the +y-direction by the pressing members 171 of the container 17 when the container 17 is inserted, the guide device 11 needs to be mounted in the housing 18 before the container 17 is inserted.

2-2. Second Modification

Figure 9:
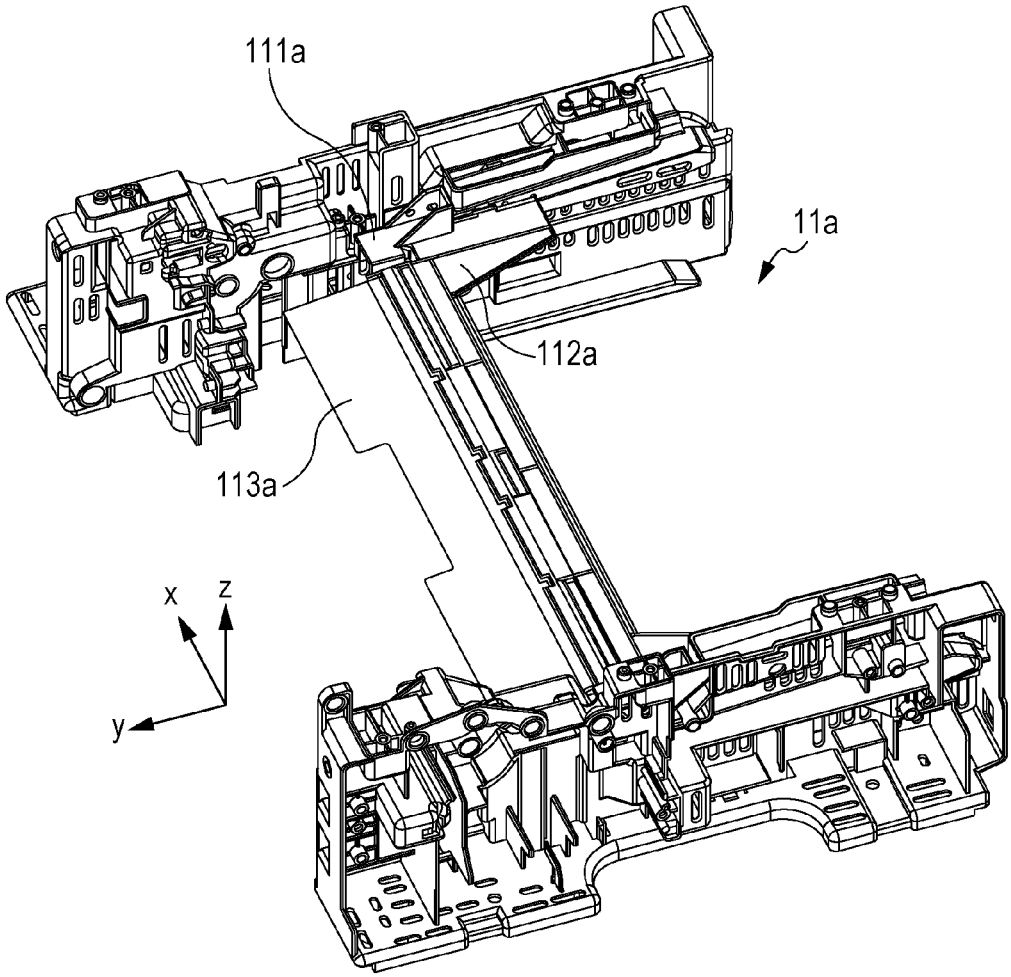
FIG. 9 schematically illustrates a guide device according to a modification.

While the moving member 112 moves along the lower surface of the plate 111 in the supply direction in the above-described exemplary embodiment, it may move along the upper surface of the plate 111. FIG. 9 illustrates a guide device 11*a* according to a second modification. The guide device 11*a* includes a plate 111*a*, a moving member 112*a*, and a guide member 113*a*. The guide member 113*a* has the same shape as that of the guide member 113 of the exemplary embodiment. The moving member 112*a* corresponds to the moving member 112 of the exemplary embodiment, but is different in structure of projecting portions. The plate 111*a* corresponds to the plate 111 of the exemplary embodiment, but is different in supporting the moving member 112*a* from below so that the moving member 112*a* moves along an upper surface thereof.

Figure 10:
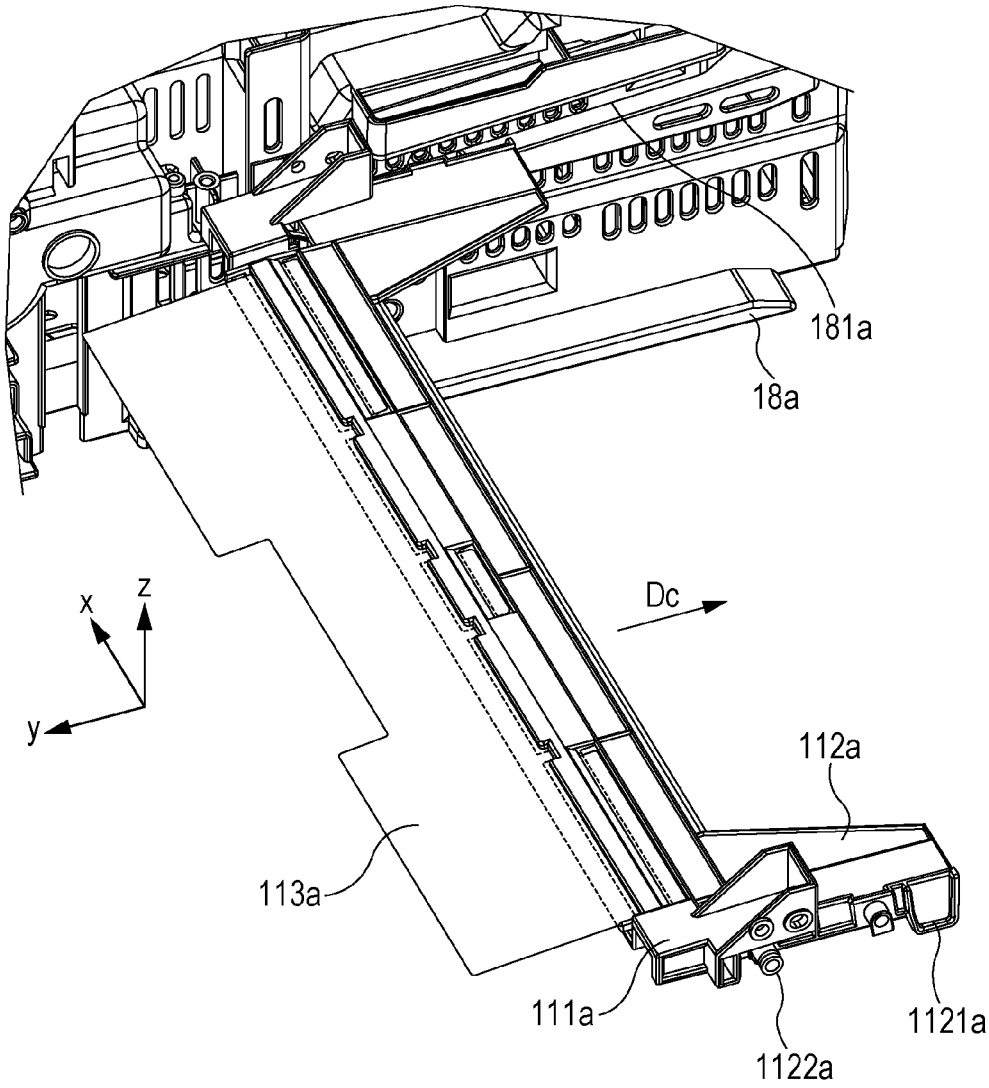
FIG. 10 illustrates details of the guide device of the modification.

FIG. 10 illustrates details of the guide device 11*a*. The moving member 112*a* has one pressed member 1121*a* and one projecting portion 1122*a* at each of +x-direction and −x-direction ends. Each pressed member 1121*a* extends in the −z-direction from the corresponding end of the moving member 112, and has a surface that receives force of pressing from the −y-direction side to the +y-direction side. A housing 18*a* corresponds to the housing 18 of the exemplary embodiment, but includes grooves 181*a* provided in portions of +x-direction and −x-direction inner walls facing the guide device 11*a*. The grooves 181*a* extend in the y-axis direction. Each projecting portion 1122*a* is located in the groove 181*a* provided on the same side of the housing 18, and moves in the longitudinal direction of the groove 181*a*, that is, in the y-axis direction.

The moving member 112*a* is drawn or pushed by an unillustrated drawing member, and receives a force to move in a direction of arrow Dc of FIG. 10, that is, in the −y-direction. While both pressed members 1121*a* are being pressed in the +y-direction, the drawing member is restricted. Hence, as illustrated in FIG. 10, the guide member 113*a* protrudes in the +y-direction from a position superposed on the plate 111*a*.

Figure 11:
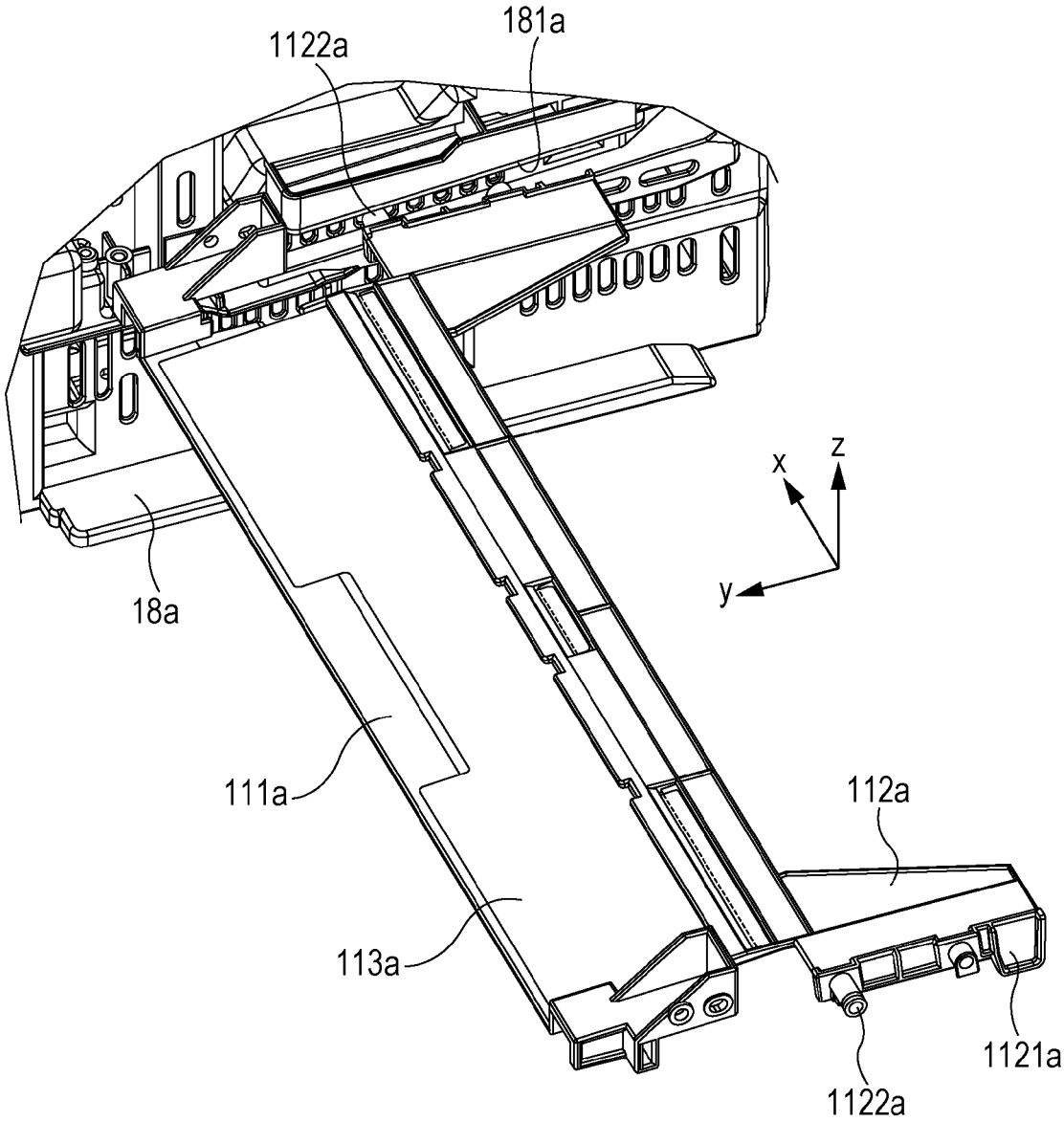
FIG. 11 illustrates a state in which a guide member of the modification is withdrawn to a position superposed on a plate.

In contrast, when the pressed members 1121*a* are not pressed in the +y-direction, the moving member 112*a* is moved in the direction of arrow Dc by the elastic force of the drawing member, so that the guide member 113*a* withdraws to the position superposed on the plate 111*a*. FIG. 11 illustrates a state in which the guide member 113*a* is withdrawn to the position superposed on the plate 111*a*. The guide member 113*a* moves along the upper surface of the plate 111*a*, and is withdrawn to the position superposed on the plate 111*a*, as illustrated in FIG. 11. Thus, a lower surface of the guide member 113*a* is covered with the plate 111*a*. Hence, even if the guide member 113*a* receives force from the lower surface, for example, because of an erroneous operation of the user, it is sometimes protected by the plate 111*a*, and is unlikely to be damaged.

Figure 12:
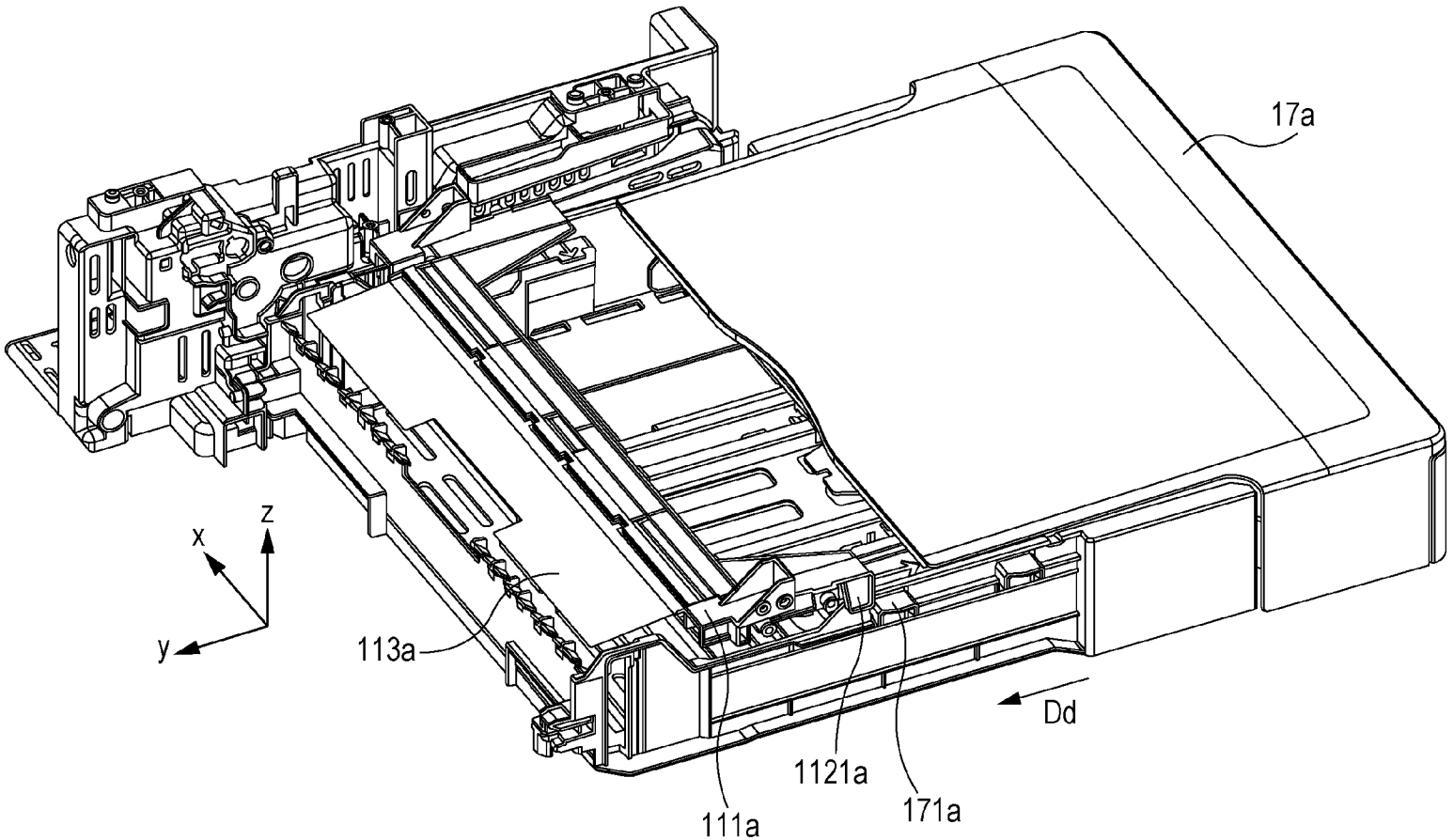
FIG. 12 illustrates how the guide device of the modification operates when a container is inserted.

FIG. 12 illustrates how the guide device 11*a* operates when a container 17*a* is inserted in the second modification. The container 17*a* includes pressing members 171*a*, similarly to the above-described exemplary embodiment. When the container 17*a* is inserted below the guide device 11*a*, the pressing members 171*a* come into contact with the pressed members 1121*a* of the moving member 112*a* and push the pressed members 1121*a* in a direction of arrow Dd. As a result, the guide member 113*a* protrudes in the +y-direction from the position superposed on the plate 111*a*.

2-3. Third Modification

While the plate 111*a* of the above-described second modification may be fixed to the housing 18*a*, it may be removably attached to the housing 18*a*.

2-4. Fourth Modification

Figure 13:
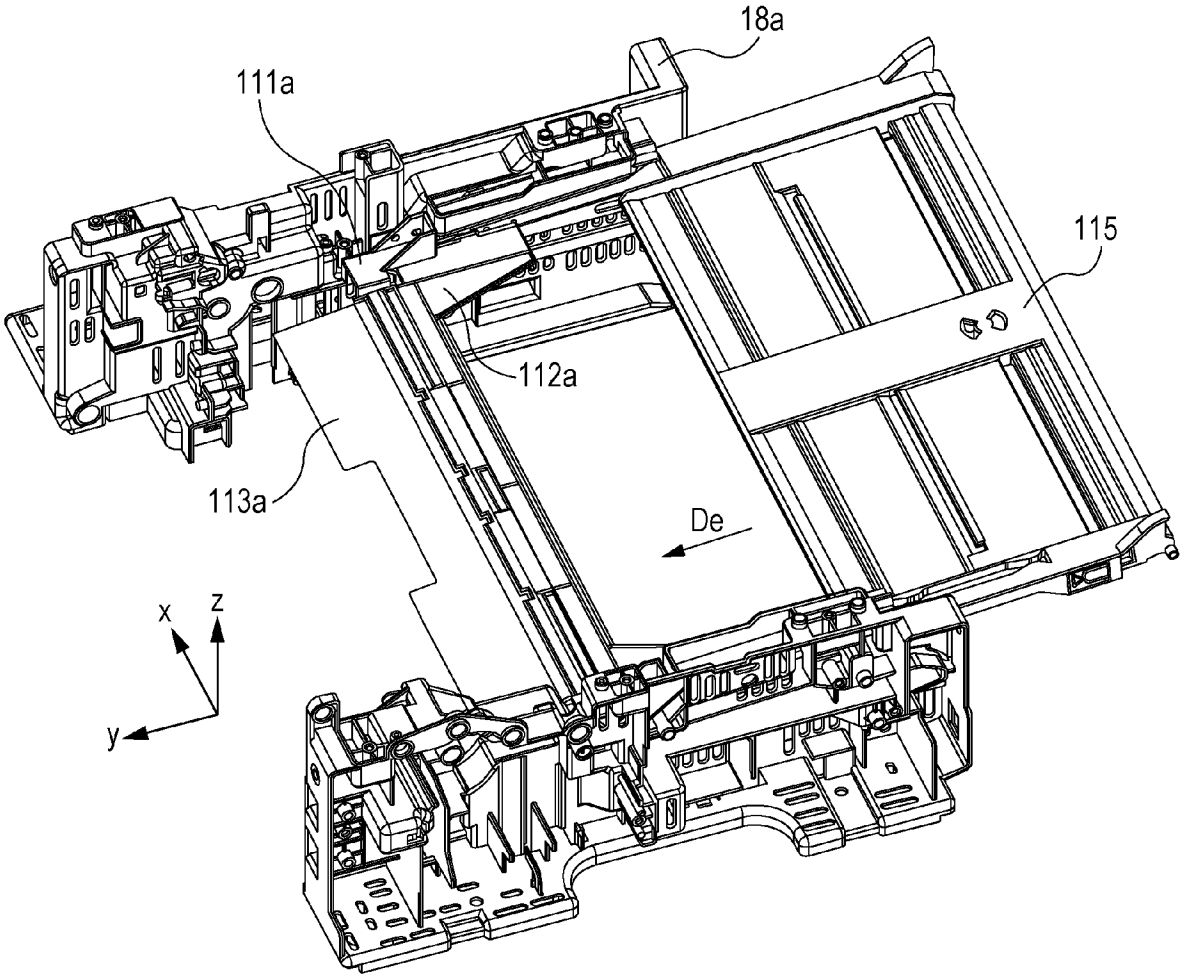
FIG. 13 illustrates a support member.

The guide device 11*a* of the above-described second modification may include a support member 115 that supports a rear end of a first sheet P1 placed on the upper surface of the guide member 113*a*. FIG. 13 illustrates the support member 115. As illustrated in FIG. 13, the guide member 113*a* and the moving member 112*a* are shorter in the y-axis direction than the housing 18. The plate 111*a* is also shorter in the y-axis direction than the housing 18, and is located at a position lower than the guide member 113*a*. Therefore, the first sheet P1 placed on the upper surface of the guide member 113*a* is supported from below at the front side in the supply direction, but is not supported from below at the rear side in the supply direction. The support member 115 supports the rear side of the first sheet P1 in the supply direction from below. The support member 115 is inserted in a direction of arrow De of FIG. 13 along grooves provided in inner walls of the housing 18*a* and at both ends in the width direction. That is, the support member 115 is located closer to the rear side in the supply direction than the guide member 113*a*, and supports a lower surface of the rear side of the first sheet P1 placed on the upper surface of the guide member 113*a*.

Figure 14:
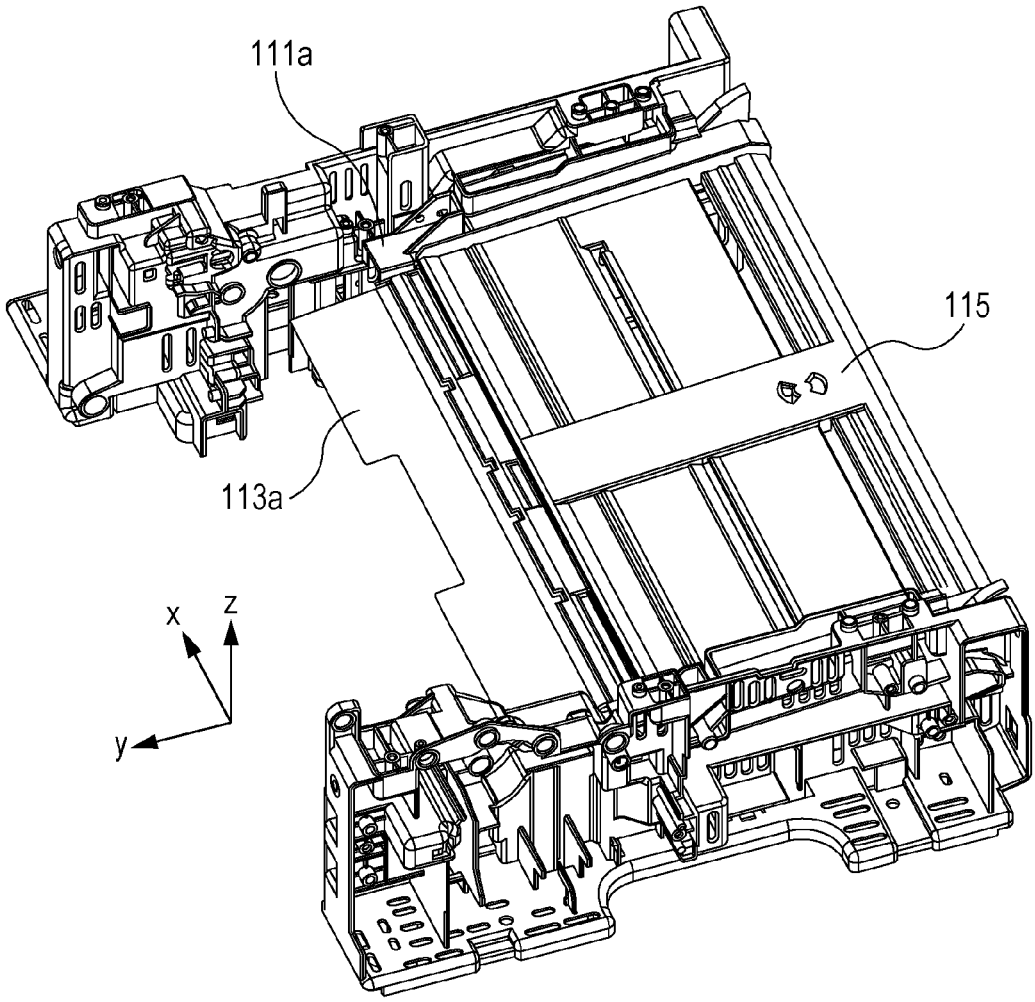
FIG. 14 illustrates a state in which the support member is inserted.

FIG. 14 illustrates a state in which the support member 115 is inserted and at least a part thereof is placed at a position superposed on the plate 111*a*. Since the support member 115 has a portion superposed on the plate 111*a* at this position, it supports the first sheet P1 placed on the upper surface of the guide member 113*a* from below. According to this structure, since the support member 115 is not related to movement of the moving member 112*a* in the y-axis direction, it may be inserted before or after the container 17*a* is inserted.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A guide device comprising:

a plate having an upper surface on which a first medium is to be placed, and provided above a space in which a container containing a second medium different from the first medium is to be inserted;

a moving member that moves along a surface of the plate in a supply direction of the first medium or in a direction opposite to the supply direction;

a substantially sheetlike guide member provided on the moving member to extend from the moving member in the supply direction, the guide member guiding the first medium in the supply direction; and a drawing member that draws the moving member toward the plate, wherein, the moving member is configured to be drawn toward the plate by the drawing member and is moved in the direction opposite to the supply direction in response to the container being taken out of the space.

2. The guide device according to claim 1, wherein any of the first medium and the second medium is supplied in the supply direction by a supply roller that contacts with the medium from above, and wherein, when the container is inserted in the space, the guide member is pushed up by the second medium contained in the container to be bent in a direction to press the first medium placed on an upper surface of the guide member against the supply roller.

3. The guide device according to claim 1, wherein, when the container is not inserted in the space, the plate is inserted in an inserting direction of the container to be placed above the space.

4. The guide device according to claim 1, further comprising:

a support member provided closer to a rear side in the supply direction than the guide member to support a lower surface on the rear side of the first medium placed on an upper surface of the guide member.

5. An image forming apparatus comprising:

the guide device according to claim 1;

a supply roller that supplies the first medium placed on an upper surface of the guide member of the guide device in the supply direction while contacting with the first medium from above; and an image forming unit that forms an image on the first medium supplied by the supply roller.

6. The guide device according to claim 1, wherein the guide member is configured to withdraw to a position superposed on the plate in response to the container being taken out of the space.

7. The guide device according to claim 6, wherein the moving member is configured to be pushed in the supply direction by the container in response to the container being inserted in the space.

8. The guide device according to claim 7, wherein the guide member is configured to protrude from the position in the supply direction in response to the container being inserted in the space.

9. The guide device according to claim 1, wherein an outermost edge disposed on a downstream side in the supply direction of the guide member is configured to withdraw to a position superposed on the plate in response to the container being taken out of the space.

10. The guide device according to claim 1, wherein the guide member comprises a cutout portion, and wherein the cutout portion coincides with a supply roller and the supplier roller is configured to contact the second medium in response to the first medium on the guide member being run out.

11. The guide device according to claim 1, wherein the drawing member comprises an elastic member configured to apply elastic force on the moving member in the direction opposite to the supply direction.

* * * * *